US005221914A

United States Patent [19]

Ubukata, deceased et al.

[11] Patent Number: 5,221,914

[45] Date of Patent: Jun. 22, 1993

[54] THERMALLY RESPONSIVE SWITCH

[75] Inventors: Susumu Ubukata, deceased, late of Nagoya, by Shinya Ubukata, Reiko Ubukata, Shinnosuke Ubukata, legal representatives; Yasukazu Mizutani, Nagoya; Isao Higashikata, Owariasahi; Hideki Koseki, Aichi, all of Japan

[73] Assignee: Ubukata Industries, Co., Ltd., Nagoya, Japan

[21] Appl. No.: 950,776

[22] Filed: Sep. 24, 1992

Related U.S. Application Data

[63] Continuation of Ser. No. 863,678, Apr. 1, 1992, abandoned.

[30] Foreign Application Priority Data

Apr. 3, 1991 [JP] Japan ..... 3-96376

[51] Int. Cl.[5] ..... H01H 37/00; H01H 71/18; H01H 37/02

[52] U.S. Cl. ..... 337/13; 337/3; 337/4; 337/140; 337/299

[58] Field of Search ..... 337/3, 4, 140, 1, 2, 337/5, 6, 12, 13, 14, 35, 53, 299, 365

[56] References Cited

U.S. PATENT DOCUMENTS 4,295,114 10/1981 Pohl ..... 337/3
4,472,705 9/1984 Carlson ..... 337/299
4,876,523 10/1989 Kushida et al. ..... 337/4

*Primary Examiner*—Harold Broome
*Attorney, Agent, or Firm*—Foley & Lardner

[57] ABSTRACT

A thermally responsive switch for protecting electric motors against overcurrent and overheating conditions includes a metallic receptacle having an elongated dome-shaped portion and an opening opposite to the dome-shaped portion, a metallic header plate secured to the one end of the receptacle so as to hermetically close the opening afterwards and having a through-aperture, a thermally responsive element disposed in the receptacle in parallel with the header plate and carrying a movable contact at one end, a rod terminal secured in the aperture of the header plate by an electrically insulating material filled in the aperture for hermetic sealing so that the terminal extends through the aperture, a fixed contact support disposed in the receptacle to be perpendicular to the terminal and having an end to which a fixed contact is secured, the support being connected at the other end to the end of the terminal projected into the receptacle, by solder, and a spring for urging the support so that it is disconnected from the terminal.

4 Claims, 3 Drawing Sheets

THERMALLY RESPONSIVE SWITCH

This application is a continuation of application Ser. No. 07/863,678, filed Apr. 1, 1992 now abandoned.

BACKGROUND OF THE INVENTION

This invention relates to a thermally responsive switch suitable for protecting electric motors employed in hermetic compressors of refrigerating machines against burnout due to overheating, and more particularly to such a thermally responsive switch capable of reliably cutting off an electrical path in an abnormal temperature condition upon termination of the life of the switch.

An electric motor employed in a hermetic compressor of a refrigerating machine is usually driven in a hermetically sealed compressor housing with refrigerant and lubricating oil surrounding it. Taking into consideration the maximum pressure values in both low and high pressure conditions during respective compressor on and off periods, the pressure in the hermetically sealed compressor housing is varied in a vast range. A thermally responsive switch used in the above-described atmosphere is required to be reliably responsive to the changes in the motor winding temperature and the current and to open an electrical path in an abnormal condition so that the running of the motor is interrupted. In order to operate the thermally responsive switch as described above, its parts including movable and fixed contacts are enclosed in a hermetic casing so that invasion of the refrigerant or the like into the casing interior can be prevented. Furthermore, the hermetic casing of the thermally responsive switch is required to have a high level of pressure tightness. Furthermore, the thermally responsive switch is required to have a high level of thermal responsiveness and specific characteristic of distinguishing between a normal current and an abnormal current. Additionally, the thermally responsive switch is required to be small in size, large in the switching capacity and superior in durability while it should be stable in the quality and cost effective.

However, conventional thermally responsive switches are disadvantageous in that the thickness of the hermetic casing enclosing the switch elements needs to be largely increased so that a sufficient pressure tightness can be secured.

Furthermore, the position of the movable contact relative to the fixed contact needs to be checked by means of X-ray irradiation after the switch casing is hermetically sealed finally. Thus, checking the position of the movable contact relative to the fixed contact cannot be readily performed.

Furthermore, the service life of the thermally responsive switch terminates after a large number of times of circuit making and breaking operation for a long period. In this case the contact surfaces of the movable and fixed contacts are melted such that the contacts are welded together, resulting in continuous flow of the current into the motor. In such a case, insulators of the motor windings are deteriorated because of the heating of the windings and consequently, a large short-circuit current is caused to flow in the circuit, resulting in the increase in the atmospheric temperature in the hermetic compressor housing. As a result, a least durable portion of the casing, for example, a so-called cluster where terminals insulated by glass are hermetically held is caused to come out of the compressor housing and flames blow out, resulting in the possibility of an outbreak of fire.

SUMMARY OF THE INVENTION

Therefore, an object of the present invention is to provide a thermally responsive switch wherein even when the contacts cannot be disengaged from each other upon termination of the service life and an abnormal current continuously flows into the motor so that the motor temperature is abnormally raised, the electrical path can be reliably cut off prior to blow of flames out of the hermetic compressor housing.

Another object of the invention is to provide a thermally responsive switch wherein the thermally responsive element is not influenced by the heat generated when a fixed contact support is secured to a terminal by use of an easily meltable material, thereby preventing reduction in the effect of an aging applied to the thermally responsive element.

Further another object of the invention is to provide a thermally responsive switch wherein the hermetic casing has a sufficiently high level of pressure tightness.

Still further another object of the invention is to provide a thermally responsive switch wherein the positional relation between the movable and fixed contacts can be readily checked in the assembly step.

The present invention provides a thermally responsive switch comprising a receptacle formed of a metallic material and having an elongated dome-shaped portion and an opening opposite to the dome shaped portion, and a header plate formed of a metallic material and secured to the one end of the receptacle so as to hermetically close the opening thereof, the header plate having an aperture formed therethrough in a suitable portion thereof. A thermally responsive element is disposed in the receptacle and supported at one of two ends thereof on a portion of the receptacle. The thermally responsive element carries at the other end a movable contact secured thereto and is formed of a thermally deformable material such as a bimetal or the like. The thermally responsive element has a generally shallow dish-shaped portion reversing and restoring its curvature with a snap action in response to different temperature values. A terminal is secured in the aperture of the header plate by an electrically insulating material filled between the peripheral wall surface of the aperture and the outer periphery of the terminal so that the terminal extends through the aperture. A fixed contact support is disposed in the receptacle so as to be generally perpendicular to the terminal and has an end to which a fixed contact is secured so as to cooperate with the movable contact. An easily meltable material is provided for connecting the other end of the fixed contact support to an end of the terminal projected to the interior of the receptacle so that the other end of the fixed contact support is secured to the end of the terminal. Urging means is provided in the receptacle for urging the fixed contact support so that it is disconnected from the terminal.

It is preferable that the urging means comprise a metallic spring disposed between the header plate and the fixed contact support together with an electrical insulator, a spring formed of an electrically insulating material and disposed between the header plate and the fixed contact support, or a spring formed of a shape memory material.

The thermally responsive switch in accordance with the present invention is mounted in the compressor housing hermetically enclosing the compressor, together with the motor. When an abnormal current flows in the motor in the overload or locked-rotor condition, the thermally responsive switch protects the motor against an abnormal temperature increase by engaging the contacts and disengaging the movable contact from the fixed contact repeatedly until the abnormal condition passes away.

The contacts are welded together to continuously close the electrical path when the service life of the thermally responsive switch terminates during engagement and disengagement of the contacts in the abnormal condition of the motor. In this case, however, the easily meltable material connecting the terminal with the fixed contact support is melted or loses its connecting force because of further increase in the motor temperature, resulting in disconnection of the fixed contact support from the terminal. As a result, the electrical path to the motor is cut off and accordingly, a state of emergency such as the blow of flames out of the compressor housing can be prevented.

Furthermore, the thermally responsive switch of the invention provides a high level of pressure tightness since the hermetically sealed receptacle is formed into the elongated dome-shaped one. Additionally, the positional relation between the movable and fixed contacts can be readily checked in the assembly step since the elongated dome-shaped receptacle has at one end the opening closed by the header plate afterwards.

Other objects of the present invention will become obvious upon understanding of the illustrative embodiment about to be described. Various advantages not referred to herein will occur to one skilled in the art upon employment of the invention in practice.

BRIEF DESCRIPTION OF THE DRAWINGS

The embodiment of the invention will be described with reference to the accompanying drawing in which.

DESCRIPTION OF THE PREFERRED EMBODIMENT

Figure 1:
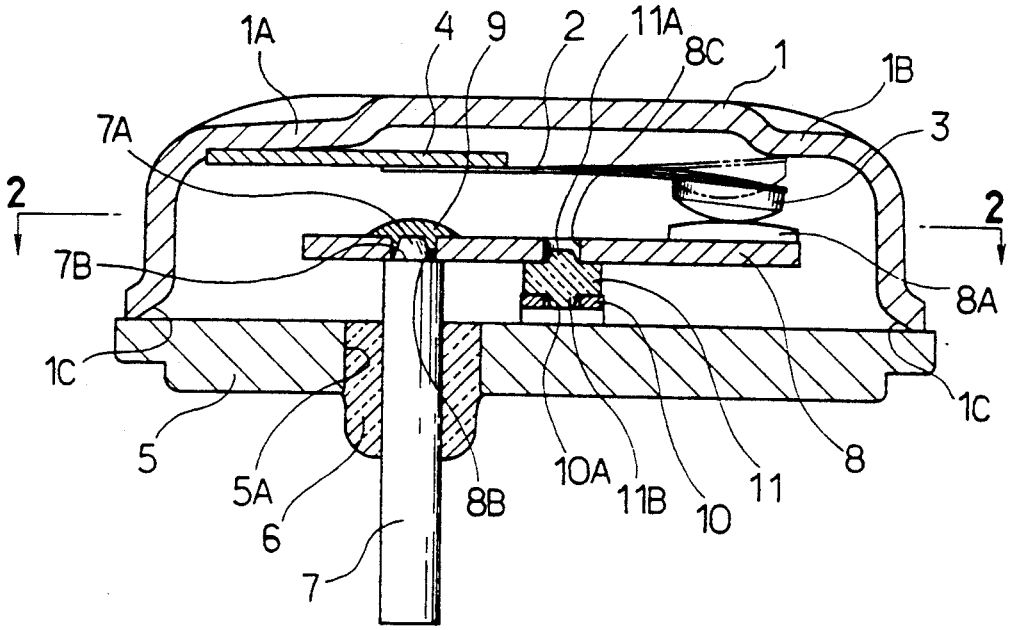
FIG. 1 is a longitudinal sectional view of the thermally responsive switch of an embodiment in accordance with the present invention.
Figure 2:
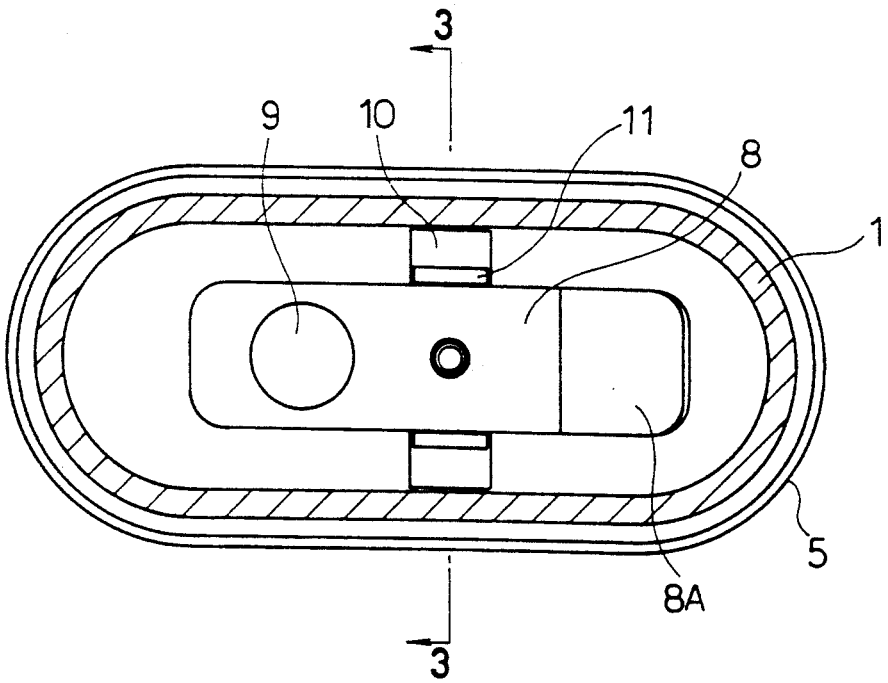
FIG. 2 is a transverse sectional view of the thermally responsive switch taken along line 2—2 in FIG. 1.
Figure 3:
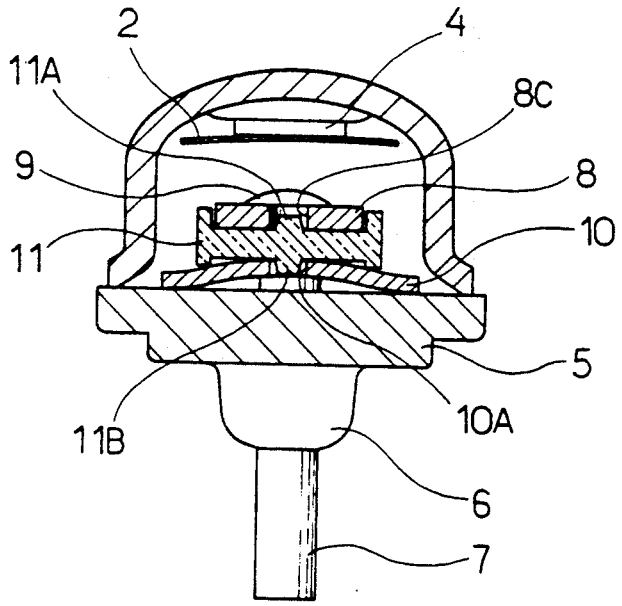
FIG. 3 is a cross sectional view taken along line 3—3 in FIG. 2.

One embodiment of the present invention will be described with reference to the accompanying drawings. A generally shallow elongated dome-shaped receptacle 1 of the thermally responsive switch is formed by drawing a rolled steel sheet by a press and has generally spherical surface portions at opposite ends in the directions of its elongation and a semi-circular central portion. The receptacle 1 includes a flat fixing portion at the inside of one of the spherical surface portions and a small projection 1B at the inside of the other spherical surface portion. A thermally responsive element 2 formed of a thermally deformable material such as a bimetal is disposed in the receptacle 1. The thermally responsive element 2 carries a movable contact secured to a movable end thereof by way of a spot welding and is secured at the other fixed end to one of two ends of a support 4 formed of a suitable metal plate, by the spot welding. The support 4 is secured at the other end to the fixing portion 1A of the receptacle 1 by the spot welding.

A header plate 5 is formed of a steel sheet having a thickness larger than the receptacle 1. The header plate 5 has a through aperture 5A formed in a suitable portion thereof, for example, in the vicinity of its central portion. A rod terminal 7 is inserted through the aperture 5A and secured in position by an electrically insulative filler 6 such as glass selected in consideration of the thermal expansion coefficients of the terminal 7 and the header plate 5 such that a compression type hermetic sealing is provided, as well known in the art. A fixed contact 8A formed from a material such as a silver alloy is secured to one of two ends of a fixed contact support 8. The fixed contact support 8 is secured by an easily meltable material 9 to an end of the terminal 7 positioned in the receptacle interior so as to be substantially perpendicular to the terminal 7 and so that the fixed contact 8A secured thereto cooperates with the movable contact 3. The securing or restraining force of the easily meltable material 9 is reduced at an emergency condition temperature, as will be described later.

The fixed contact support 8 has a small through hole 8C formed in its central portion. An insulator 11 formed of an electrically insulative material such as a ceramic is disposed under the fixed contact support 8 so that its upper projection 11A is inserted in the hole 8C. A leaf spring 10 is interposed between the insulator 11 and the header plate 5 so that the fixed contact support 8 is urged by the leaf spring 10 so as to be disconnected from the terminal 7. The leaf spring 10 has a small central hole 10A into which a lower projection 11B of the insulator 11 is inserted such that free movement of the leaf spring 10 on the header plate 5 is prevented. The header plate 5 is secured to an open edge 1C of the receptacle 1 by a ring projection welding so that the receptacle 1 is hermetically closed and so that the fixed contact 8A cooperates with the movable contact 3.

Describing in more detail the connection of the fixed contact support 8 with the terminal 7, the distal end of the terminal 7 positioned in the interior of the receptacle 1 is tapered so as to serve as a support projection 7A. The maximum diameter of the support projection 7A is determined to be smaller than the diameter of the terminal 7. The terminal 7 has a shoulder 7B by which it is bounded from the support projection 7A. The fixed contact support 8 has a receiving hole 8B formed in its fixed end side. The diameter of the receiving hole 8B is determined to be larger than the maximum diameter of the support projection 7A and smaller than the diameter of the terminal 7. The fixed contact support 8 is positioned by inserting the support projection 7A into the receiving hole 8A and butting the shoulder 7B against it and then, the fixed contact support 8 is secured to the terminal 7 by the easily meltable material 9 such as solder. Alternatively, the fixed contact support 8 may be positioned by use of mounting jigs. For example, the header plate 5 with the terminal 7 is attached to a first jig (not shown) and the fixed contact support 8 is attached to a second jig (not shown). The first jig is butted against the second jig so that the jigs are positioned in a predetermined positional relation, and then, the fixed contact support 8 is secured to the terminal 7 by the easily meltable material 9. In this case it is understood that the support projection 7A and the receiving hole 8B may be eliminated.

It is desirable that the above-described thermally responsive element 2 be processed in an aging step in which the thermally responsive element 2 is left in a thermostatic oven whose temperature is set at 300° C., for a predetermined period of time and then returned to an atmosphere of the ordinary temperature, for the purpose that different operating temperatures at which the thermally responsive element 2 reverses and restores its curvature respectively are not varied for a long period. The thermally responsive element 2 is already secured to the support 4 by the spot welding before the above-described aging step. The temperature of the heat induced at the time of the spot welding of the support 4 to the fixing portion 1A of the receptacle 1 is raised instantaneously and limitedly. However, the heating is performed not to reduce the effect of the aging step for the thermally responsive element 2. Moreover, since the fixed contact support 8 is secured to the terminal 7 by the easily meltable material 9 such as solder, the thermally responsive element 2 is not influenced by the heat induced from a soldering iron in the present invention.

The contact pressure between the movable and fixed contacts 3, 8A is varied in the calibration of the operating temperature of the thermally responsive switch so that the thermally responsive element 2 reverses its curvature at a predetermined operating temperature, for example, at 130° C. This operating temperature calibration can be performed by externally applying pressure to the flat portion 1A so that the flat portion 1A is slightly deformed. More specifically, since the thermally responsive element 2 is secured via the support 4 to the receptacle 1 at its one end and carries the fixed contact 3 at its other end, even slight deformation in the flat portion 1A results in a large displacement of the movable contact 3. Thus, the variation of the contact pressure in a vast range can be achieved by the deformation of the receptacle 1 whose pressure tightness is not influenced by the range of deformation. Furthermore, an amount of projection of the projection 1B is determined so that the distance between the movable and fixed contacts 3, 8A is regulated by the projection 1B when the thermally responsive element 2 reverses its curvature at a predetermined temperature with snap action to thereby occupy a position shown by the dotted line in FIG. 1.

The operation of the thermally responsive switch will now be described. When the thermally responsive switch is connected so that a current supplied to the motor protected by the thermally responsive switch flows through the terminal 7 and the header plate 5, the current is supplied to the motor through an electrical path formed by the terminal 7, fixed contact support 8, fixed contact 8A, movable contact 3, thermally responsive element 2, support 4, receptacle 1, and header plate 5 in turn. A large current flows into the motor for a short period of time during the starting. A normal running current flows into the motor after the starting. In these cases, the thermally responsive element 2 is subjected to heat depending upon the total amount of heat (Joule's heat) generated in the above-mentioned electrical path. However, the temperature of the thermally responsive element 2 is not raised to the predetermined operating temperature, for example, 130° C., so that the motor continues to run.

An amount of current flowing into the motor is continuously increased when an abnormal condition increases the load connected to the motor. Additionally, the temperature of the refrigerant gas in the compressor housing is abnormally raised even though the normal running current flows into the motor. In these cases, the atmospheric temperature in the hermetically sealed compressor housing in which the thermally responsive switch is provided or the ambient temperature is transferred to the interior of the thermally responsive switch. The thermally responsive element 2 reverses its curvature with snap action, occupying the position shown by dotted line in FIG. 1. As a result, the movable contact 3 is disengaged from the fixed contact 8A such that the current flowing into the motor is cut off. Furthermore, a rotor of the motor is locked when the motor torque is below a load torque. Additionally, an excessive current flows into the motor when the starting period is prolonged more than the normal starting period of 2 or 3 seconds. In these cases, an amount of the heat to which the thermally responsive switch is subjected from circumference and an amount of heat generated in the switch interior are abnormally increased. When the temperature of the thermally responsive element 2 is raised to the value of 130° C., the thermally responsive element 2 reverses its curvature with snap action such that the movable contact 3 is disengaged from the fixed contact 8A, thereby cutting off the motor current. Subsequently, when the temperature of the thermally responsive element 2 drops to another operating temperature, for example, 90° C. by self-cooling, the thermally responsive element 2 restores its former curvature with snap action such that the movable contact 3 is engaged with the fixed contact 8A again.

Figure 4:
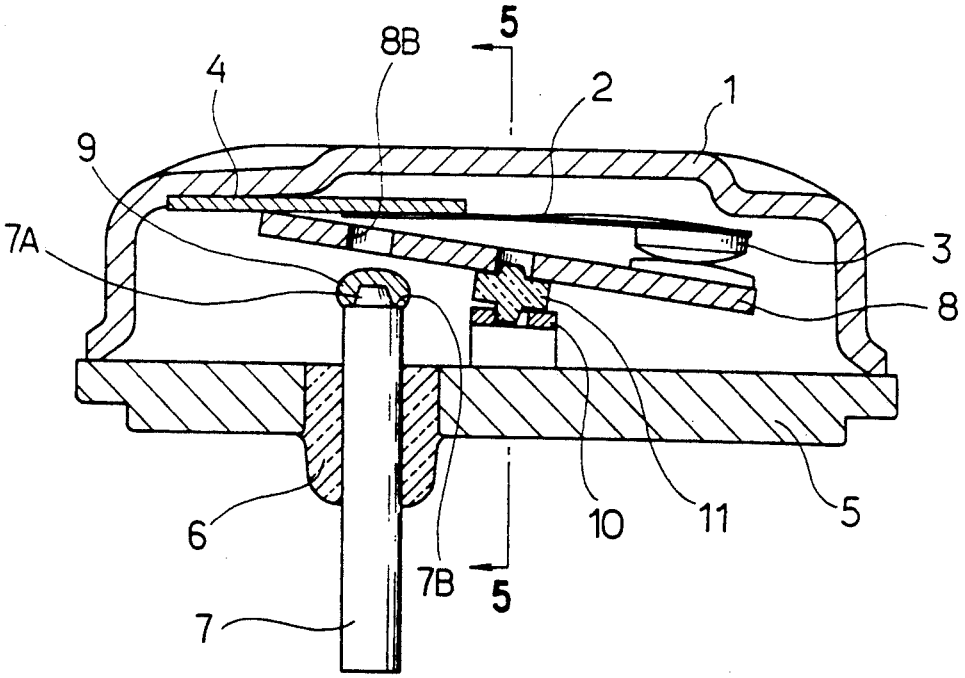
FIG. 4 is a view similar to FIG. 1 in the case where an easily meltable material connecting a fixed contact support with a terminal is melted such that the support member is disconnected from the terminal.
Figure 5:
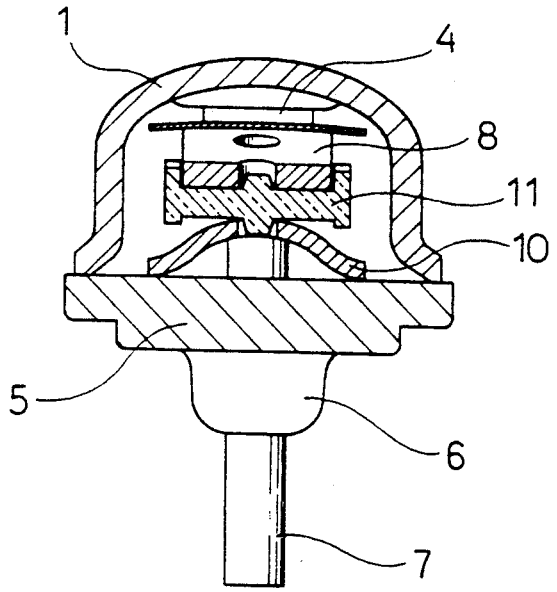
FIG. 5 is a cross sectional view taken along line 5—5 in FIG. 4.

When the cause of abnormality in the motor cannot be eliminated or when the locked-rotor condition continues, for example, the thermally responsive element 2 of the switch repeats its curvature reversing and restoring operations to engage the movable contact 3 with the fixed contact 8A and disengage the movable contact 3 from the fixed contact 8A alternately repeatedly. At last, because of fatigue of the thermally responsive element 2 or the welding of the contacts, the electrical path cannot be cut off even when the temperature of the thermally responsive element 2 reaches the operating temperature of 130° C. Consequently, the atmospheric temperatures in the motor housing and the switch casing are further increased. In this emergency condition, when the atmospheric temperature around the easily meltable material 9 reaches the emergency condition temperature or the melting temperature of the easily meltable material 9 or the value at which its securing force is reduced, for example, 150° C., the easily meltable material 9 removes constraint between the circumference of the receiving hole 8B of the fixed contact support 8 and the fixing projection 7A on the terminal 7. Consequently, the fixed contact support 8 is disconnected from the terminal 7 by a restoring force of the leaf spring 10 disposed on the insulator 11 positioned on the header plate 5, so that the electrical path is reliably cut off, as shown in FIGS. 4, 5.

Although the leaf spring is employed as a mechanism for disconnecting the fixed contact support 8 from the terminal 5 in the foregoing embodiment, the mechanism should not be limited to this kind of spring. Any construction allowing the fixed contact support 8 to disconnect the fixed contact support 8 from the terminal 5 may be employed. Furthermore, a shape memory material such as a shape memory alloy may be used instead of the spring. In this case the transformation temperature of the shape memory material is determined so that the portion of the fixed contact support 8 where it is secured to the terminal 5 is deformed during the normal running of the motor. Furthermore, a spring formed of an electrically insulative material such as a ceramic or heat resisting resin may be employed. In this case the insulator 11 is not necessitated.

In addition to solder as a lead-tin alloy, the easily meltable material 9 may be obtained by mixing some of tin, lead, bismuth and cadmium at a suitable rate. In this case the melting point of the mixture can be rendered lower than that of the solder. Furthermore, a synthetic resin or the like may be employed as the easily meltable material 9. In consideration of the temperature at which the synthetic resin or the like undergoes the thermal deformation, the shape of the synthetic resin before thermal deformation can be applied as a securing function which is reduced as the thermal deformation is initiated.

Furthermore, the thermally responsive switch of the invention provides a high level of pressure tightness since the hermetically sealed receptacle 1 is formed into the elongated dome-shaped one. Additionally, the positional relation between the movable and fixed contacts 3, 8A can be readily checked in the assembly step since the elongated dome-shaped receptacle 1 has at one end the opening closed by the header plate 5 afterwards.

The foregoing disclosure and drawings are merely illustrative of the principles of the present invention and are not to be interpreted in a limiting sense. The only limitation is to be determined from the scope of the appended claims.

We claim:

1. A thermally responsive switch comprising:

a) a receptacle formed of a metallic material and having an elongated dome-shaped portion and an opening opposite to the dome-shaped portion;

b) a header plate formed of a metallic material and secured to the one end of the receptacle so as to hermetically close the opening thereof afterwards, the header plate having an aperture formed therethrough in a suitable portion thereof;

c) a thermally responsive element disposed in the receptacle and supported at one of two ends thereof on a portion of the receptacle, the thermally responsive element carrying at the other end a movable contact secured thereto, the thermally responsive element being formed of a thermally deformable material and having a generally shallow dish shaped portion reversing and restoring its curvature with a snap action in response to different temperature values;

d) a terminal secured in the aperture of the header plate by an electrically insulating material filled between the peripheral wall surface of the aperture and the outer periphery of the terminal so that the terminal extends through the aperture;

e) a fixed contact support disposed in the receptacle so as to be generally perpendicular to the terminal and having an end to which a fixed contact is secured so as to cooperate with the movable contact;

f) an easily meltable material connecting the other end of the fixed contact support to an end of the terminal projected to the interior of the receptacle so that the other end of the fixed contact support is secured to the end of the terminal; and g) urging means provided in the receptacle for urging the fixed contact support so that the fixed contact support is disconnected from the terminal upon lowering of a securing force of the easily meltable material.

2. A thermally responsive switch according to claim 1, wherein the urging means comprises a metallic spring disposed between the header plate and the fixed contact support together with an electrical insulator.

3. A thermally responsive switch according to claim 1, wherein the urging means comprises a spring formed of an electrically insulating material and disposed between the header plate and the fixed contact support.

4. A thermally responsive switch according to claim 1, wherein the urging means comprises a spring formed of a shape memory material.

* * * * *